US009163474B2

(12) United States Patent
Ramon

(10) Patent No.: US 9,163,474 B2
(45) Date of Patent: Oct. 20, 2015

(54) SHAPE MEMORY CUP SEAL AND METHOD OF USE

(71) Applicant: Baker Hughes Incorporated, Houston, TX (US)

(72) Inventor: Michael Ramon, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 306 days.

(21) Appl. No.: 13/679,211

(22) Filed: Nov. 16, 2012

(65) Prior Publication Data

US 2014/0138088 A1 May 22, 2014

(51) Int. Cl.
*E21B 33/12* (2006.01)
*E21B 33/126* (2006.01)

(52) U.S. Cl.
CPC ..... *E21B 33/12* (2013.01); *E21B 33/126* (2013.01); *E21B 33/1208* (2013.01); *E21B 33/1212* (2013.01)

(58) Field of Classification Search
CPC ..... E21B 33/12; E21B 33/126
USPC ..... 166/387, 302, 202, 119, 179
See application file for complete search history.

(56) References Cited

U.S. PATENT DOCUMENTS 2,052,006 A * 8/1936 Taylor ..... 166/311
4,424,865 A 1/1984 Payton, Jr.
5,226,492 A * 7/1993 Solaeche et al. ..... 166/196
7,743,825 B2 6/2010 O'Malley et al.
8,393,388 B2 * 3/2013 Bishop et al. ..... 166/119
2004/0069502 A1 * 4/2004 Luke ..... 166/387
2004/0194970 A1 * 10/2004 Eatwell et al. ..... 166/387
2007/0103680 A1 5/2007 De Vandiere et al.
2007/0144731 A1 * 6/2007 Murray et al. ..... 166/120
2007/0240877 A1 * 10/2007 O'Malley et al. ..... 166/179
2007/0261863 A1 * 11/2007 Macleod et al. ..... 166/387
2010/0236794 A1 * 9/2010 Duan et al. ..... 166/387
2011/0252781 A1 * 10/2011 Johnson et al. ..... 60/527
2011/0259587 A1 * 10/2011 Joseph et al. ..... 166/277
2012/0055667 A1 3/2012 Ingram et al.

FOREIGN PATENT DOCUMENTS

WO WO 2010127240 A1 * 11/2010 ..... E21B 33/12

* cited by examiner

*Primary Examiner* — Giovanna C Wright
*Assistant Examiner* — Tara Schimpf
(74) *Attorney, Agent, or Firm* — Steve Rosenblatt

(57) ABSTRACT

A packer cup assembly uses a shape memory alloy packer cup reformed for run in into a cylindrical shape about a mandrel with opposed end rings that extend radially further out during run in to protect the cup. Upon application of a thermal stimulus the cup reverts to a functional cup seal shape by engaging the rim and parts of the cup to the surrounding wellbore. The shape change can also involve a shortened axial dimension that results in the cup shape moving away from the end ring to which it is unattached. The stimulus is provided with well fluids or artificially through heaters or other techniques. External elongated protective elements can be provided to overlay the cup seal during run and bend outwardly with the cup seal during reversion to its functional shape.

19 Claims, 6 Drawing Sheets

SHAPE MEMORY CUP SEAL AND METHOD OF USE

FIELD OF THE INVENTION

The field of the invention is wellbore isolation and more particularly thermally energized seals having a cup shape and related methods for running in such seals to avoid damage to them.

BACKGROUND OF THE INVENTION

Wellbore isolation needs arise in many contexts and a variety of sealing designs have been used to meet this need. Packers are run in to a desired location and then set with mechanical force or hydraulic pressure to extend slips for anchoring and a sealing element for sealing. Some packers are inflated to a sealing position using tubing pressure.

Another type of isolation device is the cup seal. One such design shown in U.S. Pat. No. 4,424,865 uses the basic elastomer cup shape and includes a base and internal fingers of a shape memory alloy so that upon exposure to heat above a predetermined temperature, the ribs get stiffer and move the cup outwardly against the surrounding tubular to enhance the seal. Packer cups have also been formed out of a shape memory polymer and reformed before run in to a smaller cup shape. After getting to the desired location the temperature exceeds a predetermined level and the shape reverts to an original shape that results in operative engagement of the cup seal with the surrounding tubular. Variations of this design are shown in US Publication 2012/0055667 FIGS. 13-15.

US Publication 2012/0055667 FIGS. 13-15 forms the cup shape for run in but with the rim of the cup being smaller than the inside diameter of the surrounding tubular. In deviated wellbores the rim is exposed to being dragged on the inside wall of the surrounding tubular which can cause the cup to either rip or invert if its open end is oriented in the same direction as for run in. The present invention addresses this issue with a run in shape that is preferably cylindrical or up against the mandrel that supports the cup. End rings are provided that have a slightly larger dimension than the cup run in dimension so that any dragging on a surrounding tubular such as with a deviated well will not abrade the cup while still allowing the cup the ability to assume the original shape with a thermal stimulus and seal in the wellbore. As another option there can be elongated members that are affixed to the mandrel or end ring at one end and have the opposite end free. They can also protect the cup during delivery and can be further covered with retainer material to keep the components in their respective positions for run in without adversely affecting the ability to hold differential pressure once actuated. These and other aspects of the present invention will be more readily apparent to one of ordinary skill in the art from a review of the detailed description of the preferred embodiment and the associated drawings while recognizing that the full scope of the invention is to be determined by the appended claims.

SUMMARY OF THE INVENTION

A packer cup assembly uses a shape memory alloy packer cup reformed for run in into a cylindrical shape about a mandrel with opposed end rings that extend radially further out during run in to protect the cup. Upon application of a thermal stimulus the cup reverts to a functional cup seal shape by engaging the rim and parts of the cup to the surrounding wellbore. The shape change can also involve a shortened axial dimension that results in the cup shape moving away from the end ring to which it is unattached. The stimulus is provided with well fluids or artificially through heaters or other techniques. External elongated protective elements can be provided to overlay the cup seal during run and bend outwardly with the cup seal during reversion to its functional shape.

DETAILED DESCRIPTION OF THE PREFERRED EMBODIMENT

Figure 1:
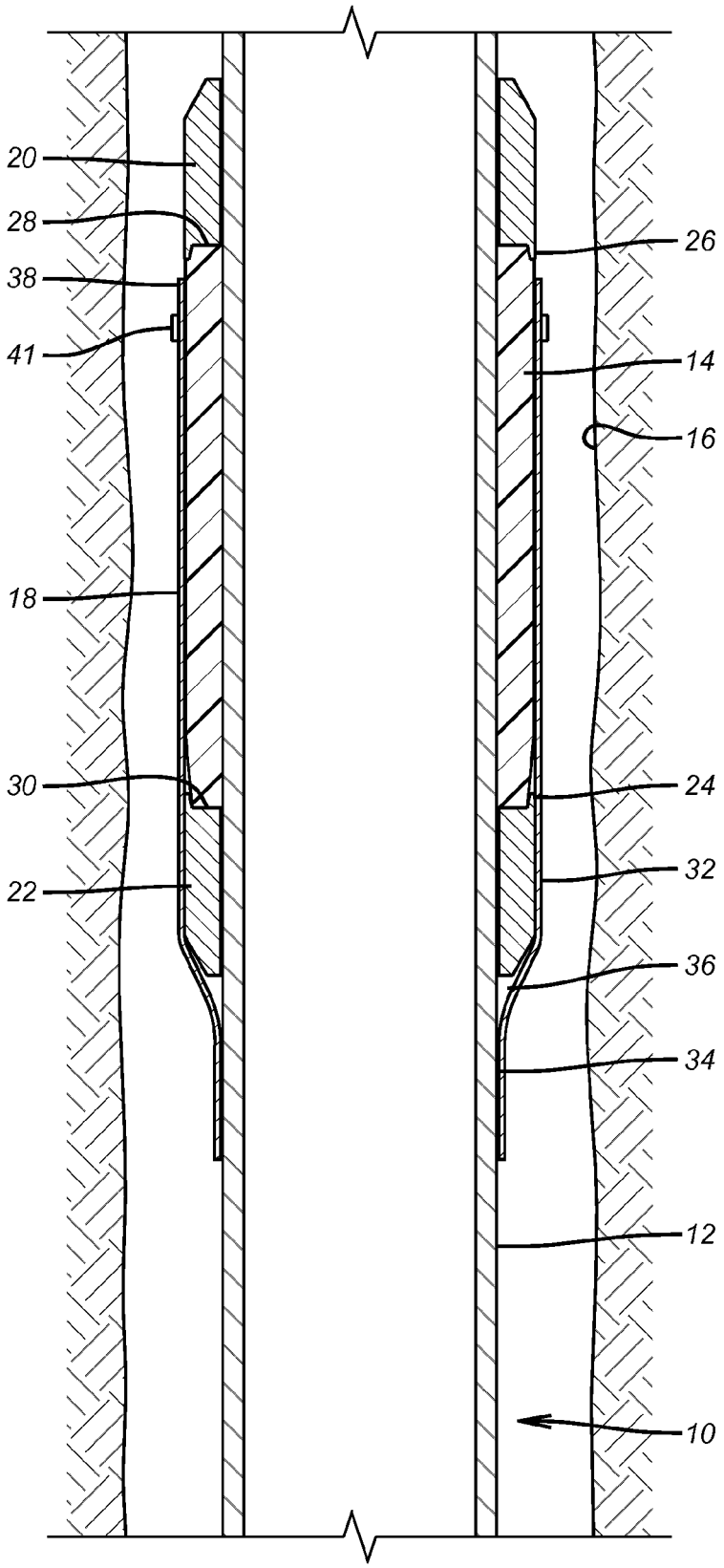
FIG. 1 is a section view during run in for the embodiment with external elongated members for cup protection.

Referring to FIG. 1 a tubular string 10 acts as a mandrel 12 for the cup seal 14 in the run in condition. The cup seal 14 is initially fabricated from shape memory polymer to the desired dimension to seal against a surrounding borehole or tubular 16. For run in, the shape is reformed above the transition temperature and put into an annular cylindrical shape so that it contacts the mandrel 12 and has an outside diameter 18 that is as big or preferably smaller than the outside diameter of the end rings 20 and 22. End ring 22 has a peripheral axially oriented ring 24 while end ring 20 has a similar ring 26 that extends toward ring 24 but at a spaced location. The cup seal 14 in the run in position has an end 28 that is located between end ring 20 and mandrel 12. As heat is supplied preferably by well fluids and the cup seal 14 assumes its functional cup shape the upper end 28 simply moves out from behind the end ring 20 and out toward the borehole or tubular 16. Lower end 30 of the cup seal 14 is secured to end ring 22 with adhesive or bonded or is otherwise sealingly secured with equivalent techniques. Optional elongated steel strips 32 can be affixed to the mandrel 12 at 34 by techniques such as welding or with a circular clamp to name a few options. Alternatively, or additionally, the strips 32 can be attached to the end ring 22 either directly or through an intermediate structure 36 as shown in FIG. 1. The strips 32 have ends 38 that preferably stop short of the opposing end ring 20 but that can optionally extend further and overlap the end ring 20. While there may be an overlapping relation there is preferably no fixation to avoid adding resistance to the packer cup 14 as it passes its transition temperature and assumes the functional packer cup shape as in FIGS. 4-6. The strips 32 can be coated such as with rubber in a thin layer 41 to further protect the strips 32 during run in. Additionally or alternatively, the strips 32 can be bound with a fiber or other type of band to keep the strips against the cup 14 for run in but to provide minimal resistance to the reforming of the shape of the cup 14 in response to a thermal signal such as the temperature of the well fluids. Ideally, the strips 32 should be thin enough to avoid creation of bypass passages in the operating position of the cup 14 against the borehole or surrounding tubular 16.

Figure 2:
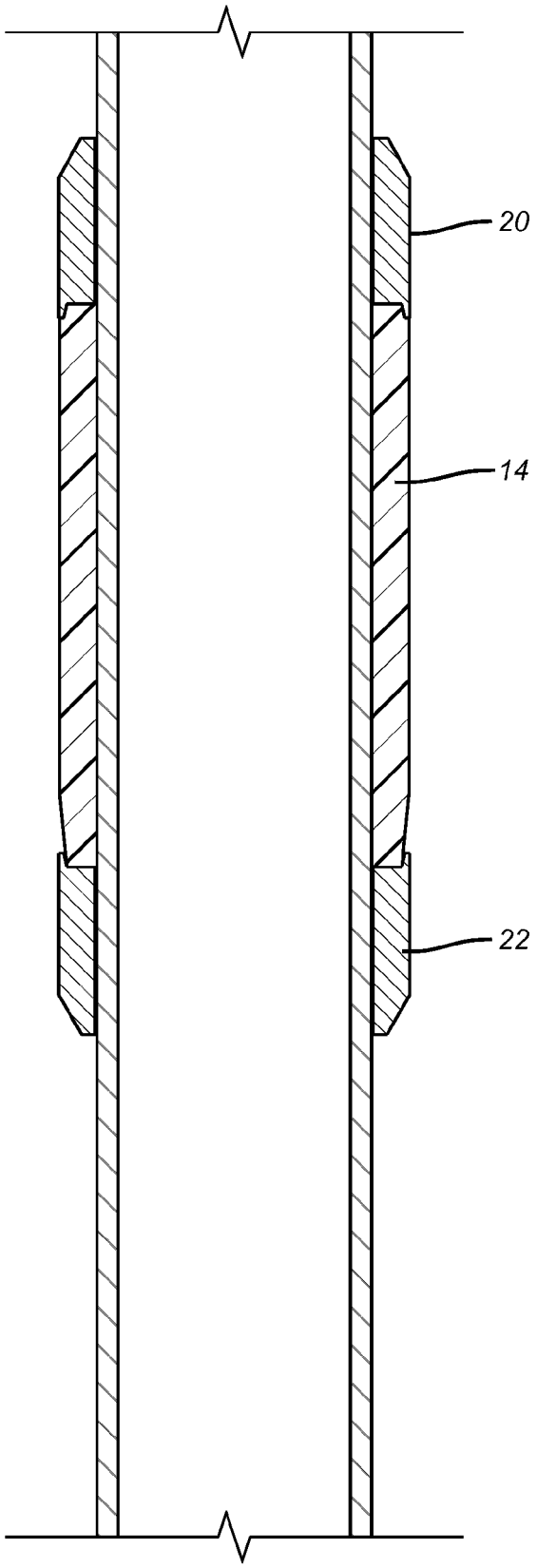
FIG. 2 is the embodiment of FIG. 1 without the external elongated members for cup protection.
Figure 3:
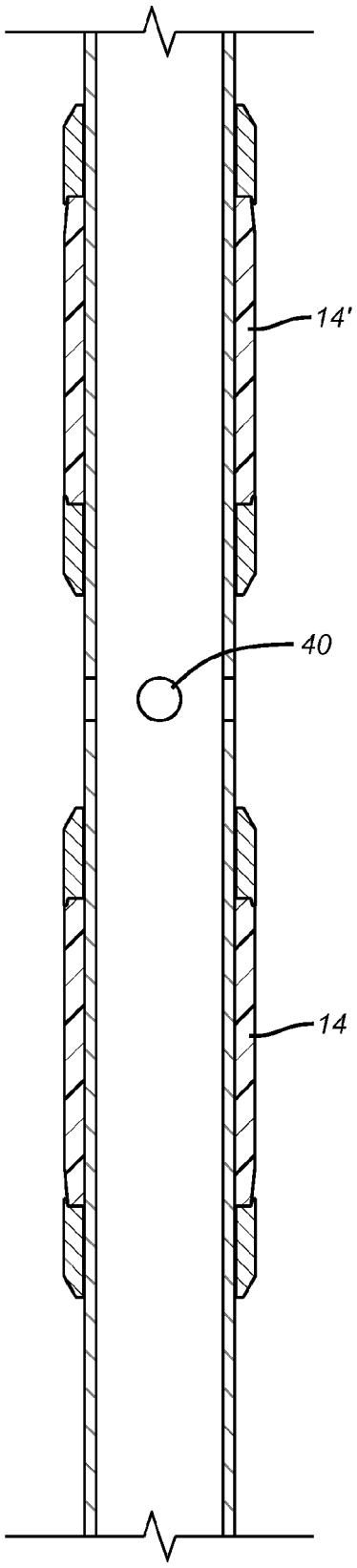
FIG. 3 shows tandem packer cups in section during run in where the orientation of the cups is opposed.

FIG. 2 is the same as FIG. 1 leaving off the optional strips 32. FIG. 3 shows an arrangement similar to FIG. 2 without the strips 32 and with tandem cups 14 and 14' that will have opposite orientations so that a zone is isolated between them and about the ports 40 for formation treatment such as fracturing or for other purposes.

Figure 4:
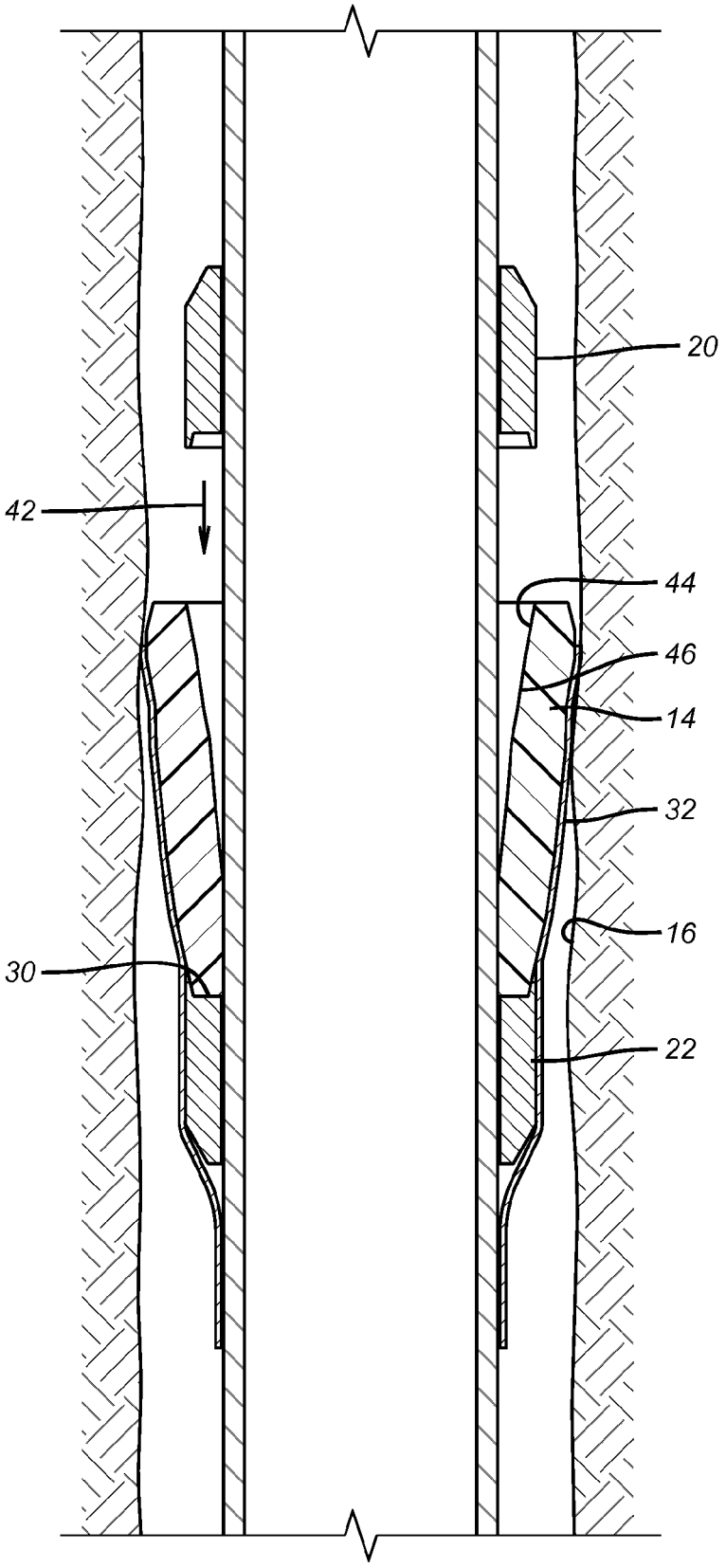
FIG. 4 is the view of FIG. 1 with the cup brought above its transition temperature so that it can assume the sealing position.
Figure 5:
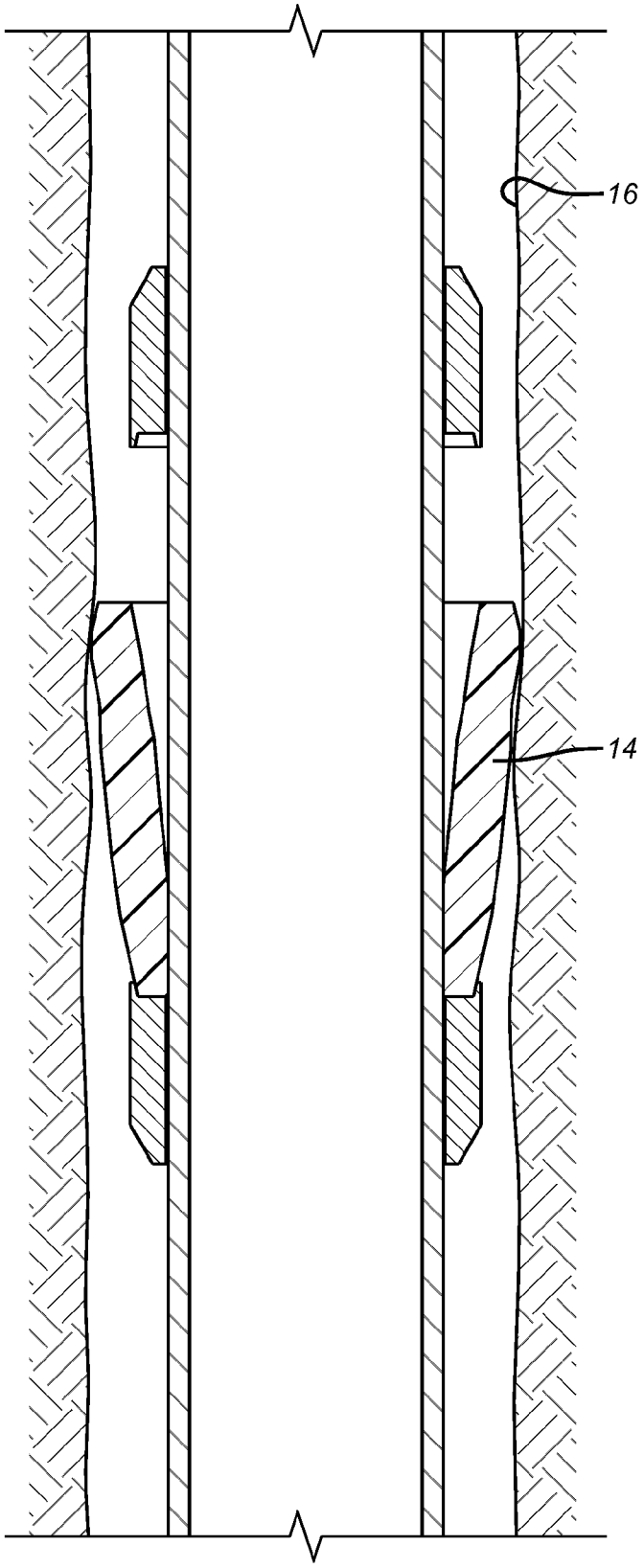
FIG. 5 is the view of FIG. 2 with the cup brought above its transition temperature so that it can assume the sealing position.
Figure 6:
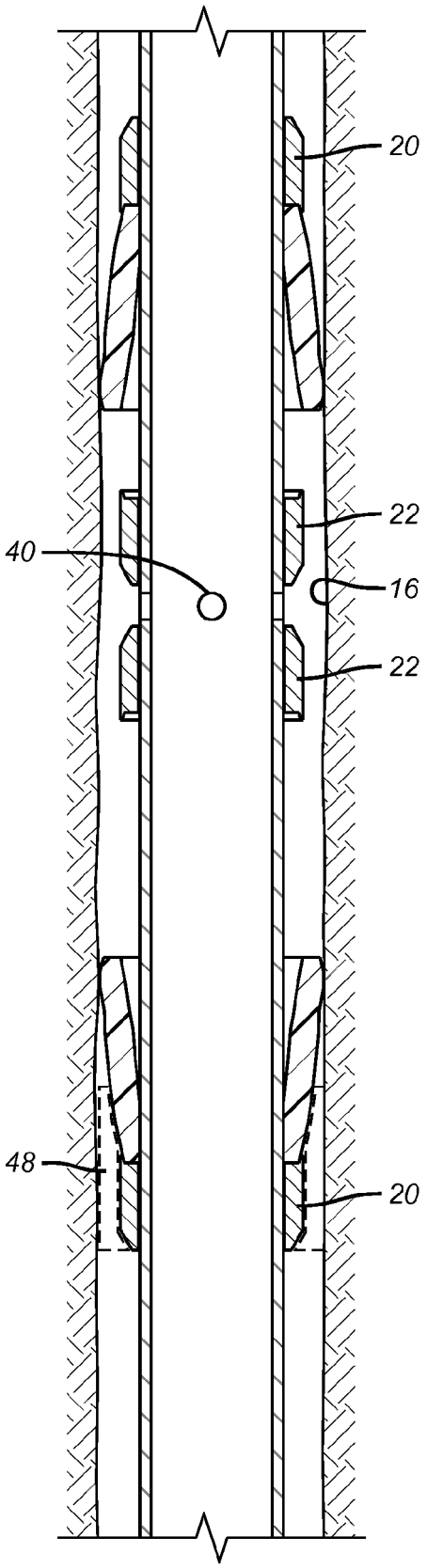
FIG. 6 is the view of FIG. 3 with the cups brought above their transition temperature so that they can assume the sealing position.

Comparing FIGS. 4-6 with 1-3 the cup 14 has crossed its transition temperature and reformed into a cup shape. In the case of FIGS. 4 and 5 the cup 14 has pulled away from end ring 20 and it rim 42 has moved out radially toward the surrounding tubular or borehole 16. Lower end 30 of the cup 14 has stayed attached to the end ring 22. The ring 22 can have an exterior taper to match the inner sloping wall 46 of the cup 14. The strips 32 are seen in FIG. 4 as moving out with the cup 14 to the borehole or tubular 16. FIG. 6 shows the cups 14 and 14' in opposed orientations.

The cups 14 and 14' can be in the same orientation and back each other up. The end rings 20 and 22 can be steel or they can be other materials. End ring 22 is designed to act as a thimble once the cup 14 is activated and reverts back to the cup shape. The cups 14 or 14' can be of a type of shape memory polymer that has two transition temperatures for setting at the lower temperature and reverting back to an annular cylindrical shape at an even higher temperature to facilitate removal.

Those skilled in the art will appreciate that a shape memory polymer cup can be reformed prior to run in so that it can be run in a protected state from end rings that have a greater radial dimension for run in. The cup can shrink axially from the end ring to which it is not attached as it grows radially outwardly. That end ring can have a peripheral ring 48 that is continuous or discontinuous to help protect the rim of the cup during run in with the cup just moving past that peripheral ring when crossing a transition temperature. The end ring that is not attached to the cup can be fixed. The end rings can also be non-metallic. The strips can be circumferentially spaced or overlapping with equal or unequal lengths. The strips can be inside the cup wall 44 although exterior mounting affords greater abrasion protection during run in.

The above description is illustrative of the preferred embodiment and many modifications may be made by those skilled in the art without departing from the invention whose scope is to be determined from the literal and equivalent scope of the claims below:

I claim:

1. An isolation device for a borehole or subterranean tubular comprising:

a mandrel;

at least one packer cup having a run in position where its shape over an axial length comprises an annular cylinder about said mandrel, said packer cup thermally triggered to an operating position against the borehole or tubular when located at a predetermined location;

opposed end rings, comprising a first and second end ring, wherein the said first end ring is fixedly mounted to said mandrel and further comprising an axially extending segment extending past a first end of said packer cup to retain said first end of said packer cup in said annular cylinder shape in said run in position, said first end of said packer cup moving axially away from said fixed axially extending segment in said operating position; and the said second end ring fixedly securing a second end of said at least one packer cup to said mandrel.

2. The device of claim 1, wherein:

at least one of said first and second end ring having a peripheral dimension at least as great as the annular cylinder peripheral dimension for said packer cup in said run in position.

3. The device of claim 2, wherein:

said second end ring forms a thimble to back up said packer cup in said operating position.

4. The device of claim 1, wherein:

said packer cup is in contact with said mandrel over the axial length of said packer cup for said run in position.

5. The device of claim 1, further comprising:

a plurality of strips mounted radially over said packer cup in said run in position and movable radially with said packer cup as said packer cup moves toward said operating position.

6. The device of claim 5, further comprising:

the said first end ring adjacent said packer cup, said strips supported on one end from said mandrel or said end ring.

7. The device of claim 6, wherein:

said strips are circumferentially spaced apart or overlapping.

8. The device of claim 6, wherein:

said strips are selectively restrained for run in and said restraining is overcome with movement of said packer cup to said operating position.

9. The device of claim 1, wherein:

said packer cup is a shape memory polymer.

10. The device of claim 1, wherein:

said packer cup moves to said operating position with heat at a first temperature level and then back toward said run in position with heat at a second temperature level higher than said first temperature level.

11. The device of claim 10, further comprising:

said packer cup shrinks axially as it moves toward said operating position.

12. The device of claim 1, wherein:

said at least one packer cup comprises a plurality of packer cups having the same or opposite orientations for an open end thereof when in said operating position.

13. The device of claim 1, wherein:

said packer cup shrinks axially away from said first end ring and radially away from said mandrel when moving to said operating position.

14. A method of running in and operating at least one packer cup at a subterranean location comprising:

running in at least one packer cup on a mandrel with said packer cup being in a run in position with an annular cylinder shape over an axial length about said mandrel;

thermally triggering said packer cup to change shape to an operating position of a cup shape with an open end at a predetermined location;

providing opposed end rings, comprising a first and second end ring, wherein the said first end ring is fixedly mounted to said mandrel and further comprising an axially extending segment extending past a first end of said packer cup to retain said first end of said packer cup in said annular cylinder shape in said run in position, said first end of said packer cup moving axially away from said fixed axially extending segment in said operating position; and providing the said second end ring to fixate a second end of said at least one packer cup to said mandrel.

15. The method of claim 14, comprising:

providing at least one end ring adjacent said packer cup during running in with a peripheral dimension at least as large as said packer cup; and retaining said packer cup during running in with an axially oriented extension overlapping said first end ring.

16. The method of claim 14, comprising:

extending strips outside and radially overlapping said packer cup for protection during said running in.

17. The method of claim 14, comprising:

using said second end ring at the subterranean location to act as a thimble for said packer cup in said operating position.

18. The method of claim 17, comprising:

using heat for reshaping said packer cup between said run in and said operating positions; and making said packer cup from a shape memory polymer.

19. The method of claim 14, comprising:

running in a plurality of packer cups on said mandrel with said packer cups having the same or opposite orientations for an open end thereof when in said operating position.

* * * * *